US006715895B2

(12) United States Patent
Wasow et al.

(10) Patent No.: US 6,715,895 B2
(45) Date of Patent: Apr. 6, 2004

(54) LUMINAIRE BODY FOR A MEDICAL LIGHT, AND THE USE THEREOF

(75) Inventors: Soren Wasow, Freigericht (DE); Uwe Gampe, Dusseldorf (DE); Klaus Buss, Ganderkesee (DE)

(73) Assignee: Heraeus Med GmbH, Hanau (DE)

( * ) Notice: Subject to any disclaimer, the term of this patent is extended or adjusted under 35 U.S.C. 154(b) by 0 days.

(21) Appl. No.: 10/295,004

(22) Filed: Nov. 14, 2002

(65) Prior Publication Data

US 2003/0165053 A1 Sep. 4, 2003

(30) Foreign Application Priority Data

Nov. 19, 2001 (DE) ..... 101 56 307

(51) Int. Cl.[7] ..... F21V 19/04

(52) U.S. Cl. ..... 362/20; 362/254; 362/804; 362/572; 362/228; 362/229; 362/285; 362/286

(58) Field of Search ..... 362/20, 254, 804, 362/572, 35, 220, 233, 238, 285, 286, 228, 229

(56) References Cited

U.S. PATENT DOCUMENTS

| | | | |
|---|---|---|---|
| 1,037,566 | A | 9/1912 | Warder, Jr. |
| 1,895,543 | A | 4/1933 | Finch et al. |
| 2,310,618 | A | 2/1943 | Crossley |
| 3,308,338 | A | 3/1967 | Seidler |
| 5,032,962 | A | 7/1991 | Gehly et al. |

FOREIGN PATENT DOCUMENTS

| | | | |
|---|---|---|---|
| DE | 197 11 599 | A1 | 9/1998 |
| DE | 200 04 384 | U1 | 11/2000 |
| EP | 0 730 120 | A1 | 9/1996 |

*Primary Examiner*—Thomas M. Sember
*Assistant Examiner*—Mark Tsidulko
(74) *Attorney, Agent, or Firm*—Fulbright & Jaworski L.L.P.

(57) ABSTRACT

A luminaire body for a surgical operation light with an annular reflector has at least two electric light bulbs, a first bulb of which with its socket is associated in normal operation with a given centered position (with respect to the reflector) in the stationary part of the luminaire body, while a second bulb with its socket is situated in a reserve position away from the centered position; in case of a failure of the first bulb the positions of the sockets of both bulbs are changed by an electromagnetically operated turning service such that the second bulb can be turned to the original centered position of the first bulb for reserve-bulb operation after the first bulb has been withdrawn from the centered position. The first bulb is configured as a double-end gas discharge bulb with terminal contacts situated axially opposite one another, which is held and contacted together with the second bulb in the form of an incandescent bulb which, together with the second socket disposed at a distance, is configured as part of the turning system rotatable about an axis for holding and contacting the other end of the gas discharge bulb. In the event of failure of the first bulb the desired change in the positions of the bulbs is brought about by a releasing action and with the aid of a biased torsion spring.

11 Claims, 3 Drawing Sheets

LUMINAIRE BODY FOR A MEDICAL LIGHT, AND THE USE THEREOF

FIELD OF THE INVENTION

The invention relates to a luminaire body for a medical light, especially a surgery light, with at least two electric bulbs a first of which in normal operation is disposed with its bulb socket in a given centered position in the stationary part of the luminaire body, while a second bulb with its bulb socket is in a reserve position outside of the centered position, and in case of failure of the first bulb the sockets of both bulbs are variable in their position by an electromagnetically operated turning system, so that the second bulb can be turned into the centered position for reserve bulb operation after the first bulb is withdrawn from the centered position; the invention is furthermore addressed to the use of such a luminaire body.

BACKGROUND OF THE INVENTION

A lighting device having two electric bulbs operated alternately, such as disclosed, for example, in DE 200 04 384 U1, is known as a luminaire body; such a luminaire body is situated in the center or focal point of a reflector surrounding it, preferably an annular reflector, the reflector and luminaire body forming a common unit as a medical light or surgery light, which is mounted for rotation and turning by means of a hanger.

In U.S. Pat. No. 5,032,962 a surgery light is disclosed, which has a lighting device with two alternately energized bulbs of the same type, one of which is in a centered position optimized with respect to one reflector of the lighting device, while a second bulb remains in a reserve position in the case of normal operation. Upon the occurrence of a defect in the bulb in a first bulb socket, the first bulb is removed from the focal point of the reflector by means of a turning system and the second lamp that has previously served as a reserve bulb is positioned at the focal point.

In this manner, in case of failure of the first bulb, a virtually interruption-free lighting of the surgical field is to be made possible by a momentary switch-over to the reserve bulb while the optimal setting of the centered position in the focal point of the reflector is also retained.

If now however two discharge lamps are used as the main bulb and reserve bulb, the fail-safe quality may also be impaired by problems in the comparatively complex power supply to the gas discharge bulbs. This means that, to improve fail-safety, either a redundancy is to be provided in the power supply to the gas discharge bulbs, or in the event of failure of a single power supply to gas discharge lamps, the reserve function of the second lamp is no longer able to operate.

Furthermore, EP 0 730 120 A1 and corresponding DE 195 07 306 disclose a surgery lighting device which has at least one main bulb arranged at a required location and a replacement bulb in a waiting location close to this required location. The main bulb and the replacement bulb are adjustably mounted and controlled such that, if the main bulb burns out it is moved away from the required location and the replacement bulb is moved from the waiting location to the required location and there it is locked. The main bulb and the replacement bulb are mounted on sockets that can be moved independently of one another.

What is involved is two incandescent lamps of equal value which are supplied alternately by a common power source. Consequently an improvement of safety against failure is possible only by adding an additional power supply, which could be expected to result in an increase in cost.

Furthermore, DE 299 21 180 U1 has disclosed a fail-safe lighting device, especially one for surgical systems, which contains at least one gas discharge light bulb, the bulb having a supply unit which is connected to an additional safety power supply by switching over to a substitute power source in case of trouble. The power supply unit has a buffer storage which, upon the occurrence of trouble, provides a supply of energy for the operation of the gas discharge bulb during the changeover to the substitute power source.

OBJECTS AND SUMMARY OF THE INVENTION

The invention is addressed to the problem of creating a surgery lighting device with a main bulb and a reserve bulb, in which one of the two bulbs is configured as a discharge light bulb, while the reserve bulb is one which in its design or power is not simply equivalent to the gas discharge bulb. At the same time an optimal centered position in the reflector area is to be assumed by the reserve bulb in the case of reserve bulb operation.

The problem is solved by the invention in that the first bulb is configured as a double-ended gas discharge bulb with its contacts at its axially opposite ends, which is held and contacted in a first socket at one end, together with a second lamp configured as an incandescent bulb, which together with a second socket arranged at a distance for holding and contacting the other end of the gas discharge bulb as part of a turning device which can rotate about an axis, while by a releasing action a rotation of the turning device can be produced by means of a biased torsion spring between the turning device and the stationary part of the luminaire body.

It proves to be especially advantageous that, due to its construction, after a bulb failure a restoration of the main light (first bulb) is always necessary for the bulb change, so that after replacement of the defective main bulb it is always assured that the first lamp or discharge lamp is in the optimal position of the illumination system for normal operation.

Advantageous embodiments of the luminaire body and method of using the luminiare are described herein.

Preferably the rotation of the turning device is started by an electromagnetic release of a locking pin which is positively engaged in one of the bulb sockets, which is connected mechanically and electrically to the stationary part of the luminaire body.

The torsion spring needed in order to perform the swiveling action engages a point on the turning device off-center from the axis of rotation of the turning device.

In a preferred embodiment, one of the two bulb sockets is provided with at least one bore for positive engagement by the snapping-in of the locking pin, the latter being subjected to mechanical bias by a spring biased against the direction of the raising of the locking device.

Advantageously, the locking pin is completely removed from the bore in the bulb socket when the locking device is magnetically excited.

Furthermore, in the area of the bore provided for the locking pin, the bulb socket has a ramp surface to enable the locking pin to slide thereon until it enters into the opening.

For the repositioning of the first bulb into the centered position after bulb failure, a rotation of the turning device against the force of the torsion spring is required, this turning movement being advantageously performed manually.

The connecting contacts at the opposite ends of the gas discharge bulb operated as the first bulb are disposed along an axis that runs parallel to the axis of the turning device.

In an advantageous application, the luminaire body is inserted into an annular light which has an annular reflector spaced away from the luminaire body, so that optimum removal of the radiant heat can be performed by natural convection.

The subject matter of the invention is further explained below with the aid of FIGS. 1 to 3.

DETAILED DESCRIPTION

Figure 1:
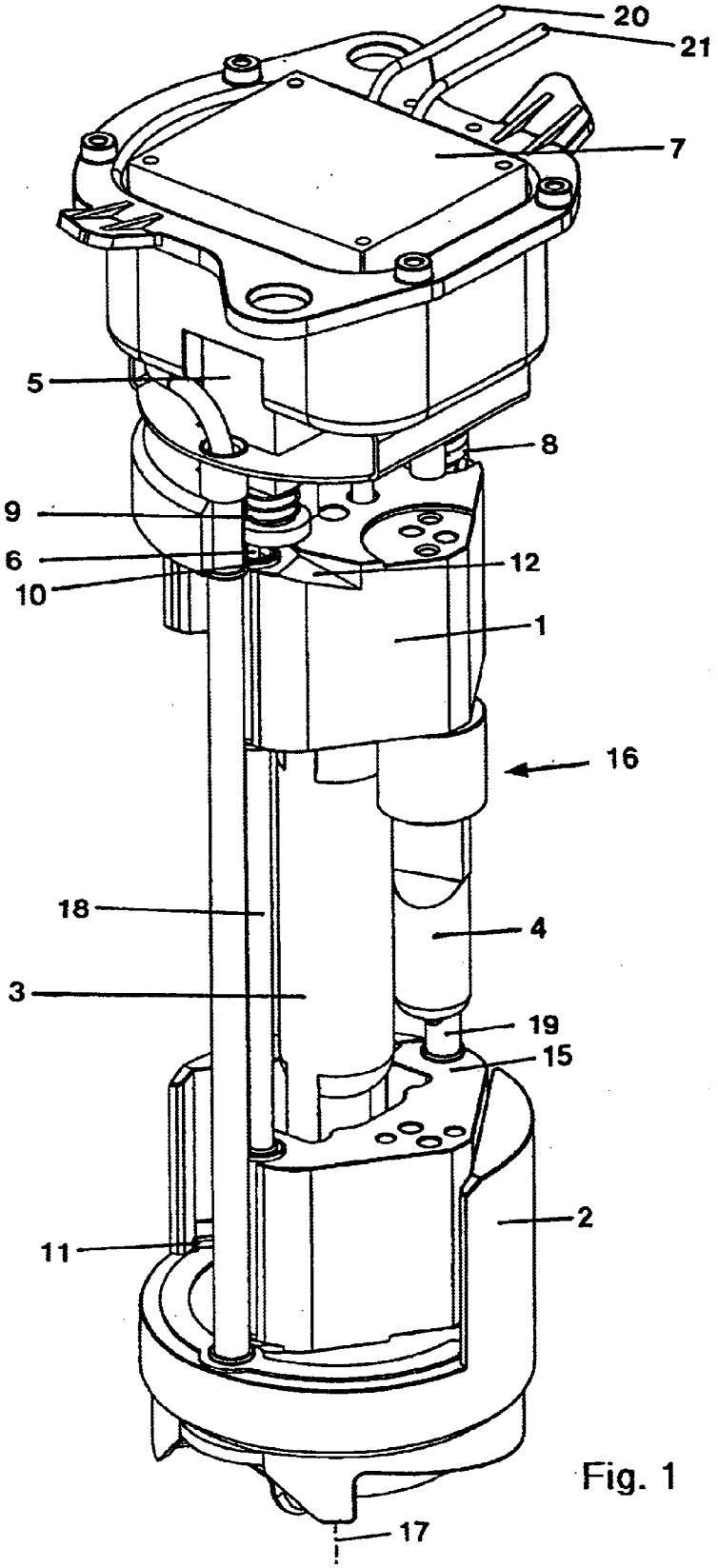
FIG. 1 shows the luminaire body of the invention without an external housing, with the gas discharge bulb serving as the first bulb shown in its centered position.

According to FIG. 1 the luminaire body, shown without an external housing for greater comprehension, has a stationary or fixed socket 2 as well as movable sockets 1 and 15, which are part of a turning device 16 and are mounted for rotation about an axis—axis of rotation 17 here represented schematically. The two sockets 1 and 15 together with the connecting bars 18 and 19 form the movable core of the turning device 16. The discharge lamp held between the first socket 1 and the second socket 15 and serving as the main light source is used as the first bulb 3, which in FIG. 1 is in its centered position (with respect to the reflector). Also seen on the left side of the axis of rotation 17 is the second bulb 4 (reserve light source) in the form of an incandescent bulb, which is based at one end and thus is fastened to the movable first socket 1. On the movable socket 1 the biased torsion spring 8 required for performing the turning action can be seen, which is in the form of a helical spring wrapped about a rod which is not seen. In normal operation it is in the biased state, with one end of the torsion spring 8 fastened to the fixed socket 2, while the other end is attached to an eccentric point of the turning device 16.

During normal operation the first lamp 3 is in the centered position, while at the same time the locking pin 6 is positively engaged in a bore in socket 1. At the same time the locking pin 6 is urged by a helical spring (pressure spring) against a lifting magnet 5 situated above it. This signifies that in its de-energized state the lifting magnet 5 leaves the locking pin in the bore 10 and thus leaves the first bulb 3 in its centered position.

Above the movable socket 1 there is also a portion of the stationary socket 2, which is also connected to a starter 7 for the first bulb (gas discharge bulb); thus the starter 7 for the gas discharge bulb serving as the first bulb can be seen above the movable socket 1 in the stationary socket 2 in FIG. 1, while the electrical connections which also serve to supply the bulbs are identified by the reference numbers 20 and 21. Near the first movable socket 1, on the surface facing the locking device, there is a ramp 12 which, when the turning device 16 is manually turned back, forces the locking pin 6 back into bore 10. Furthermore, the spring 9 for the lifting magnet 5 can be seen in FIG. 1, which without external application of force applies a permanent pressure to the locking pin 6, so that the latter is positively engaged in the bore 10 in its rest position and thus prevents movement of the turning device.

Upon failure of the first bulb 3 (the gas discharge bulb), the magnet 5 of the locking device is actuated by a sensor, here not shown, the latter overcomes the bias of the spring 9 and thus produces the positive lowering of the locking pin out of the bore 10 of socket 1, so that when the bore 10 is open the force exercised by the torsion spring on the turning device becomes effective and the second bulb 4, serving as the reserve incandescent bulb, enters into the centered position of the first bulb 3, while bulb 3 is simultaneously removed from the centered position. A stationary abutment plate 11 can be seen in the range of the rotation of the movable socket 15. Thus a virtually uninterrupted illumination of the operation field is assured, leading to a reduced intensity of illumination due to the incandescent bulb used; it is also possible, however, to continue any surgical work that may have begun. The same effect would occur also if the power supply to the gas discharge bulb 3 should fail, so that the sensor preceding the lifting magnet 5 would likewise register a bulb failure and provide for a corresponding changeover of the second lamp 4 to the centered position as the reserved bulb.

It proves to be advantageous that, on account of the double-ended discharge lamp, a resumption of operation after bulb change or after the elimination of the trouble in the power supply is immediately possible, since also the relighting of the discharge lamp 3 is greatly improved in practice.

After the end of any operation of the second bulb 4 serving as reserve bulb, the turning device 16 is manually restored to its starting position, so that the principal bulb 3 is back in its centered position. It is then tested and replaced if necessary, so that the operation of the luminaire body can be resumed without other problems. If the safety requirements are stringent, as in the case of surgery lighting, the second bulb 4 serving as a reserve bulb is at the same time examined and replaced if necessary in order to maintain a high level of safety in subsequent lighting periods.

Figure 2:
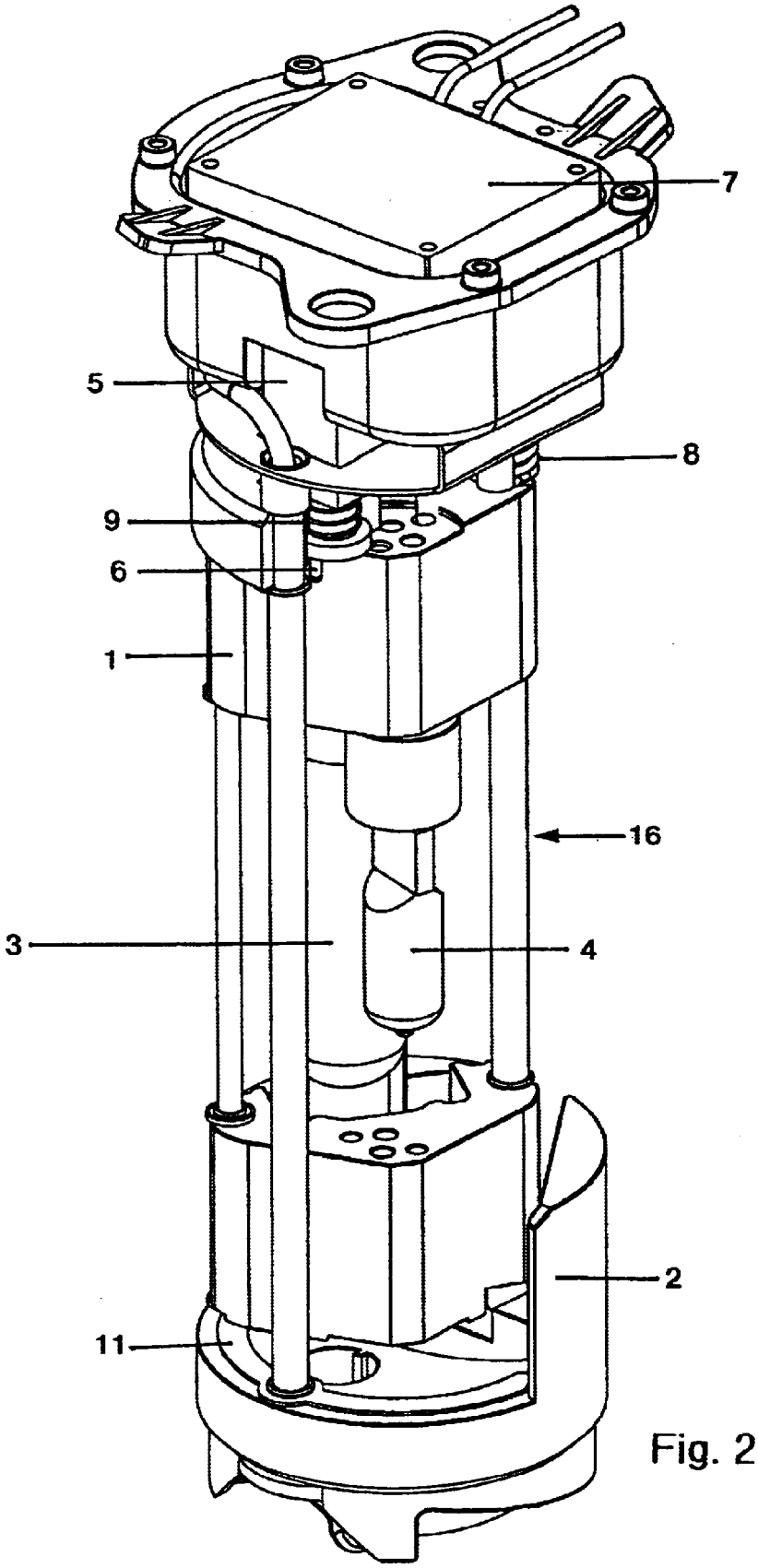
FIG. 2 shows the second bulb provided with an incandescent filament in its centered position, which it assumes after failure of the first bulb (gas discharge bulb).

FIG. 2 shows the basic element of the luminaire body with the second bulb 4 in the centered position, so that upon failure of the first bulb 3 (the main bulb) an operation can continue. In FIG. 2 it can be seen that locking pin 6 is now outside of the here-unseen bore 10, so that the bottom end of the locking pin 6 thrusts against the ramp 12, here unseen, of socket 1 (see FIG. 1). After the medical light (surgery light) is turned off, the turning device 16 is rotated to bring the second bulb 4 out of the centered position, and the bulb 3 for normal operation now comes into its starting position wherein it can be replaced in a simple manner.

Figure 3:
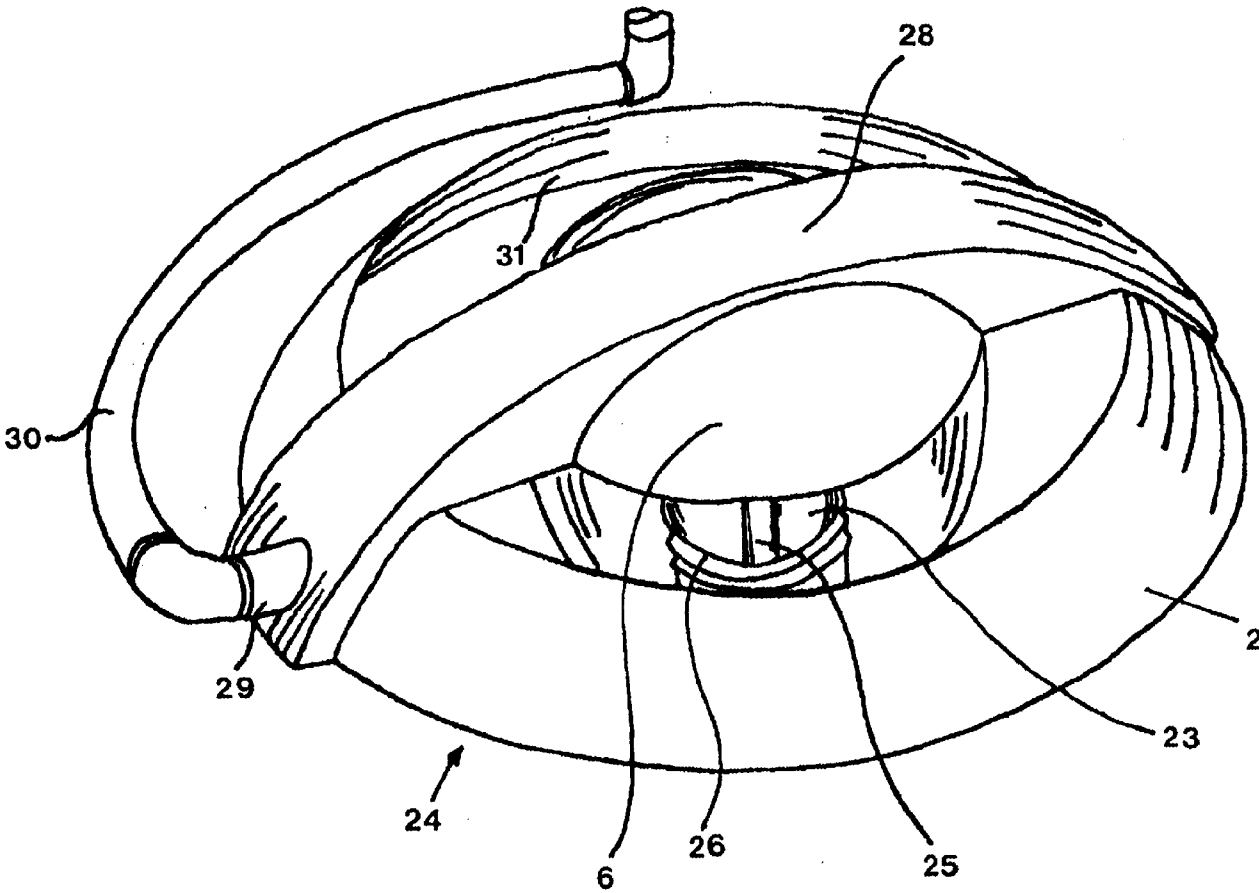
FIG. 3 shows a surgery light with the inserted luminaire body according to the invention, which is surrounded by an annular reflector.

In FIG. 3, the luminaire body 23 of the invention is at the center 25 of a surgery light 24, where the outside circumference of the housing of luminaire body 23 has a system of annular lenses 26, as disclosed in DE 200 04 384 U1. The luminaire body 23 is surrounded by an annular reflector 27 which is fastened electrically and mechanically by a diametrically disposed connecting bridge 28 to the luminaire body 23. The connecting bridge 28 is provided in the area of its attachment to the annular reflector 27 with a terminal 29 for the electrical and mechanical connection of the surgery light 24 to a bulb mounting 30 represented but fractionally. Furthermore, in FIG. 3 can be seen the mirror surface 31 on the inner side of the annular reflector 27 for reflection of the radiation emitted by the luminaire body 23, by which the radiation is turned toward the field of a surgical operation.

What is claimed is:

1. A luminaire body for a medical light comprising at least two bulbs, a first bulb of which, in normal operation with its socket, is associated with a given centered position in the stationary part of the luminaire body, and a second bulb with its socket is in a reserve position away horn the centered position, and in ease of failure of the first bulb the positions of the sockets of both bulbs can be changed by an electromagnetically operated turning device so that the second bulb can be turned to the centered position for reserve bulb operation after the first bulb is withdrawn from the centered position, wherein first bulb is configured as a gas discharge bulb with terminal contacts axially opposite one another, which is held and contacted at one end in a first socket together with a second bulb configured as an incandescent bulb, which together with a second socket arranged at a distance for holding and contacting the other end of the gas discharge bulb, is configured as part of a turning device rotatable about an axis, while by a releasing procedure a rotation of the turning device can be produced by means of a torsion spring biased between the turning device and a fixed part of the luminaire body.

2. A luminaire body according to claim 1, wherein the rotation of the turning device is initiated by electromagnetic release of a locking pin, positively engaged in one of the sockets, of a stopping device mechanically connected to the fixed part of the luminaire body.

3. A luminiare body according to claim 2, wherein the torsion spring is attached to a point of the turning device that is off-center from the axis of rotation of the turning device.

4. A luminaire body according to claim 1, wherein the torsion spring is attached to a point of the turning device that is off-center from the axis of rotation of the turning device.

5. A luminaire body according to claim 1, wherein one of the two sockets has at least one bore for positive connection by the entry therein of the locking pin, the latter being under mechanical bias from a biased compression spring contrary to the lifting direction of the locking device provided with a lifting magnet.

6. A luminaire body according to claim 1, wherein upon magnetic excitation of the locking device, the locking pin is situated in the socket outside of the bore.

7. A luminaire body according to claim 1, wherein the socket has a ramp in the direction of the bore for the locking pin, on which the locking pin can slide.

8. A luminaire body according to claim 7, wherein positioning the first bulb in the centered position a rotation of the turning device against the force of the torsion spring is necessary.

9. A luminaire body according to claim 8, wherein the position of the first bulb is accessible for a bulb change only in the centered position.

10. A luminaire body according to claim 1, wherein the oppositely lying terminal contacts of the two sockets for the discharge lamp are disposed along an axis running parallel to the axis of the turning device.

11. An annular bulb which is at a distance from the annular reflector associated with the luminaire body claim 1.

* * * * *